US005821458A

United States Patent [19]

Wenzel

[11] Patent Number: 5,821,458

[45] Date of Patent: Oct. 13, 1998

[54] SUBSTANTIALLY RIGID STRAIN RELIEF BRACKET FOR ELECTRICAL APPLIANCES

[75] Inventor: Michael David Wenzel, Pleasanton, Calif.

[73] Assignee: Orcon Corporation, Union City, Calif.

[21] Appl. No.: 824,201

[22] Filed: Mar. 25, 1997

[51] Int. Cl.[6] ..... H02G 3/18

[52] U.S. Cl. ..... 174/65 SS; 248/52; 439/568

[58] Field of Search ..... 174/65 R, 65 SS, 174/57, 135, 158 R, 168; 248/51, 52; 439/568, 449, 451, 495

[56] References Cited

U.S. PATENT DOCUMENTS

| | | | |
|---|---|---|---|
| 4,438,323 | 3/1984 | Milnes | 219/243 |
| 4,617,083 | 10/1986 | Yrizarris | 156/545 |
| 4,816,619 | 3/1989 | Heys, Jr. et al. | 174/135 |
| 4,829,157 | 5/1989 | Loyd | 219/228 |
| 4,910,362 | 3/1990 | Kinner | 174/135 |
| 4,919,743 | 4/1990 | Johnson et al. | 156/304 |

OTHER PUBLICATIONS

Crain Floor Covering Tools Catalog #119–C, Feb. '92, Milpitas California,pp. 2, 12, 20.

National Carpet Equipment Inc. of Minnisota, Catalog #1192–1, pp. 10, 16, 20.

Centerline [Taylor] Tools Product Data Sheet #893, Seam Welder, Jan. 93 Denver Colorado p. 3.

*Primary Examiner*—Kristine L. Kincaid
*Assistant Examiner*—Dhiru R. Patel
*Attorney, Agent, or Firm*—Medlen & Carroll, LLP

[57] ABSTRACT

A substantially rigid strain relief bracket is provided for use with an electrical appliance having a power cord which extends from a handle and is attached to the handle through a conventional flexible strain relief device. The strain relief bracket can be attached over the flexible strain relief device at the end of the power cord adjacent to the handle. The strain relief bracket can be permanently attached for movement to the power cord or strain relief device or, alternatively, can be removably secured in a desired position relative to the handle to enable a user to extend the power cord away from the appliance to avoid interference between the appliance and the power cord. The strain relief bracket includes a substantially rigid, hollow tubular section having a proximal end and a distal end. A spacer arm extends from the proximal end of the tubular section and terminates in a jaw which can be used to secure the bracket in one or more cutouts provided in the end of the appliance handle.

18 Claims, 2 Drawing Sheets

SUBSTANTIALLY RIGID STRAIN RELIEF BRACKET FOR ELECTRICAL APPLIANCES

TECHNICAL FIELD OF THE INVENTION

This invention relates generally to hand-held electrical appliances, and more particularly to electrical carpet seaming irons.

BACKGROUND OF THE INVENTION

Wall-to-wall carpeting is typically installed by seaming together two or more widths of carpeting in order to cover the entire area to be carpeted. The seam between two carpet pieces is typically created by cutting the adjoining carpet pieces to create trimmed edges for seaming, abutting the trimmed edges, and joining the closely abutting edges of carpeting together using a hot-melt carpet seaming tape. An electrical appliance, such as a conventional electrical carpet seaming iron, is typically used to melt the hot-melt adhesive on the seaming tape before the edges of the carpet are abutted to form the seam.

The operator of the seaming iron typically manipulates the carpet seaming iron ahead 8 inches to 10 inches with one hand, and then manipulates the two adjoining carpet edges with both hands. To create a quality seam, it is necessary for the operator to move the iron at a relatively regular speed and to quickly push the abutting carpet edges into the molten hot melt adhesive after the iron passes because hot melt adhesive sets very quickly. The operator typically has only 5–8 seconds to work the seam before the adhesive begins to set. It is, therefore, extremely inconvenient and potentially detrimental to the quality of the seaming operation if a portion of the equipment being used gets in the way or interferes with either the movement of the seaming iron, the operator, or the carpet edges. The power cord of the carpet seaming iron is particularly susceptible to becoming an impediment during the seaming operation because it emerges from the iron and can drape down alongside the iron where it interferes with making the seam. Approximately 1–2 seconds or more of the 5–8 second working time is required to move an obstructing power cord out of the way.

Manufacturers typically install a flexible strain relief device on the end of the power cord as it emerges from the end of a handle on many electrical appliances. These flexible strain relief devices can be coiled spring type devices or can be formed from flexible molded rubber or elastomers. For most conventional carpet seaming irons, the flexible strain relief device is a coiled spring. The strain relief device is used to prevent wear and tear on the end of the power cord closest to the handle, which is subjected to rotational and pulling forces, and to prevent the power cord from coming loose from the appliance.

Conventional appliances may also include cutouts on the end of the handle adjacent to the strain relief device so that the strain relief device is provided with a curved surface against which it and/or the power cord can bear, instead of a sharply angled surface which could cause kinking or wear of the power cord. It should be noted that because conventional strain relief devices are flexible, they do not prevent the power cord from presenting an obstacle during the use of an electrical appliance such as a carpet seaming iron.

Accordingly, the need exists for a device which can be used to prevent the power cord from creating an obstacle during the use of an electrical appliance such as a carpet seaming iron.

SUMMARY OF THE INVENTION

The present invention provides a substantially rigid strain relief bracket for use with an electrical appliance for positioning the power cord of the appliance away from the appliance to avoid interference between the power cord and the appliance, operator, or work.

In one embodiment, the present invention provides a substantially rigid strain relief bracket permanently mounted on a power cord of an electrical appliance, the bracket having a substantially rigid, hollow tubular section enclosing the power cord of the appliance and having a proximal end adjacent to a handle of the appliance, a distal end positioned on the power cord away from the handle of the appliance , and a wall. The interior circumference of the tubular section is sufficient for enclosing power cord. Extending from the proximal end of the tubular section is a substantially rigid spacer arm which is attached for movement to the handle of the appliance. The movement of the spacer arm, once the desired position of the bracket is set, can be restricted using conventional means.

In another embodiment, a jaw is provided at the end of the spacer arm for removably securing the bracket at a desired position in cutouts provided in the appliance handle.

In yet another embodiment, the rigid strain relief bracket is provided with a longitudinal slot which extends through the wall of the tubular section from the proximal end to the distal end, enabling the bracket to be freely attached to or removed from any conventional electrical appliance, such as, for example, a carpet seaming iron.

The other features, advantages and embodiments of the present invention will become apparent to one skilled in the art from reading the Detailed Description of the Invention together with the drawings.

DETAILED DESCRIPTION OF THE INVENTION

Figure 1:
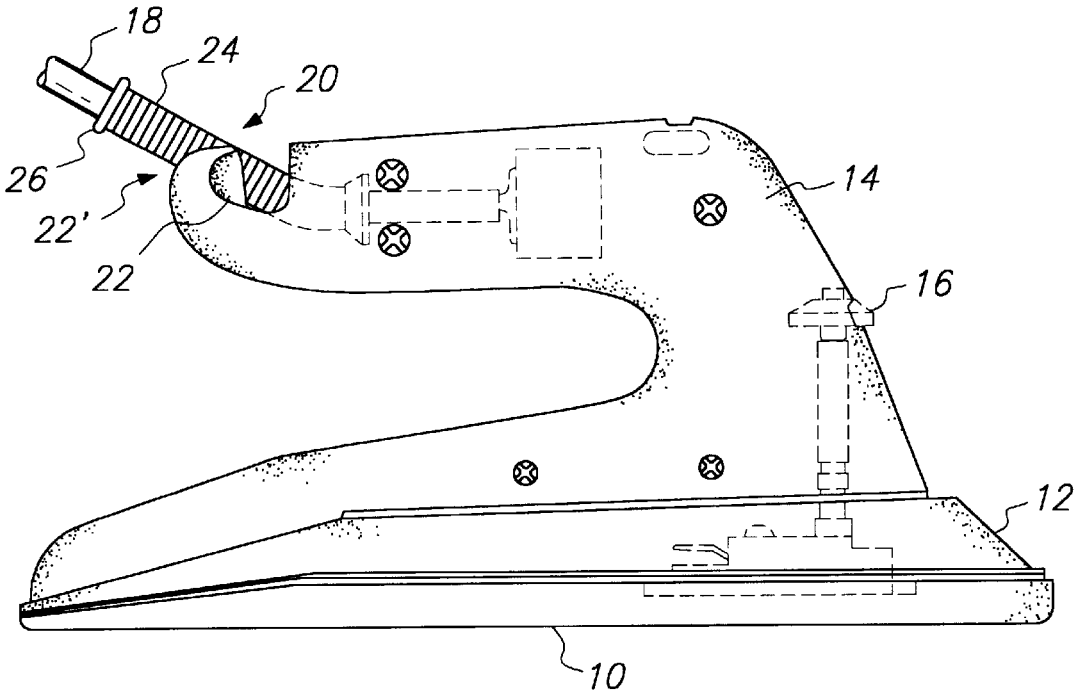
FIG. 1 is a side view of a conventional carpet seaming iron.

As shown in FIG. 1, a conventional carpet seaming iron includes a base plate 10 which is electrically heated using conventional means. Most carpet seaming irons also include a shield 12 which is provided for cooling purposes and to prevent the operator from coming into contact with the heating elements. A handle 14 is provided of a substantially non-heat conducting material such as, for example, wood or plastic. A rotary switch 16 may be provided to enable the operator to adjust the temperature of the base plate 10. Electricity is furnished to the heating elements and rotary switch 16 through power cord 18, which emerges from the end 20 of handle 14.

Figure 2:
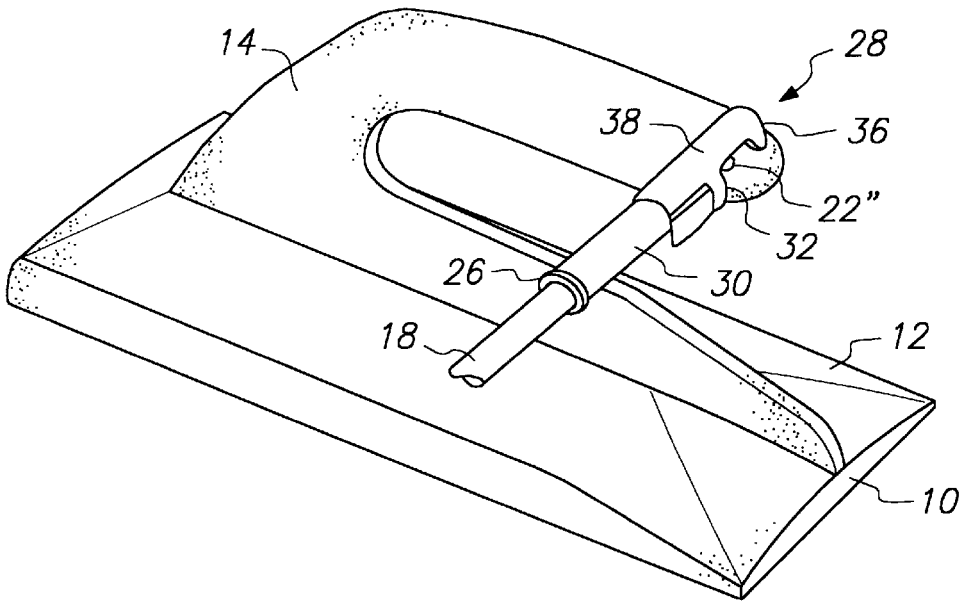
FIG. 2 is a perspective side view of an improved carpet seaming iron of the present invention provided with a strain relief bracket for selectively directing the power cord away from the appliance.

The end 20 of handle 14, like many other electrical appliances, is conventionally provided with one or more cutouts 22, 22' which provide curved surfaces against which the power cord 18 can bear. As shown in FIGS. 1 and 2, three cutouts 22, 22', 22" are typically found on carpet seaming irons, two of which are perpendicular to an axis passing through a longitudinal center of the power cord, and one of which is somewhat parallel. The power cord can "ride" in one of the cutouts, and will drape to the left or the right or the rear of the carpet seaming iron if it is riding in the left 22", right 22, or rear 22' cutout respectively.

To reduce wear and kinking of the power cord 18 as it exits from the handle 14, most conventional appliances include a flexible stress relief device 24 which reduces wear, increases flexibility and secures the power cord in the handle. The flexible stress relief device on a conventional carpet seaming iron is typically a coiled spring type device which is slipped over the end of the power cord 18 with an interior end mounted inside the handle and an exterior end 26 from which the power cord 18 emerges. The end 26 of the coiled spring is free to move along the power cord 18 as necessary. In this configuration, the coiled spring prevents unnecessary strain, kinking and wear on the end of the power cord, and mounts it securely in the end 20 of the handle 14. The coiled spring 24 is typically made from, for example, spring steel. Thus, if one pulls the free end 26 away from the handle end 20, the spring is stretched along the power cord 18. When end 26 is released, the spring returns to its normal coiled position.

Figure 3:
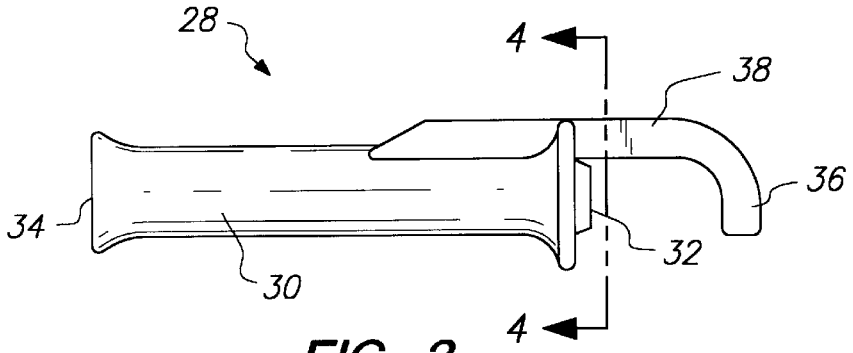
FIG. 3 is a first side view of a strain relief bracket of the present invention.

As shown in FIGS. 2 and 3, an electrical appliance such as a carpet seaming iron can be modified according to the present invention to move the power cord 18 away from the path of the electrical appliance by using a strain relief bracket 28. Strain relief bracket 28 includes a tubular section 30, having a proximal end 32 and a distal end 34, and a jaw 36 which is spaced from the proximal end 32 of tubular section 30 by spacer arm 38. Strain relief bracket 28 can be formed from any rigid or semi-rigid material, such as plastic, wood or metal, by any conventional method such as, for example, injection molding or machining. Most preferably, strain relief bracket 28 is formed as a single piece by molding.

Figure 4:
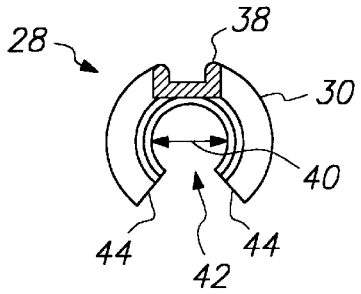
FIG. 4 is a cross-sectional view taken through line 4—4 of FIG. 3.
Figure 5:
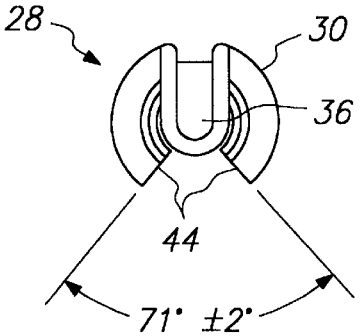
FIG. 5 is a front view of a removable strain relief bracket of the present invention.

As shown in FIGS. 4 and 5, the tubular section 30 is hollow and has an interior circumference 40 which is sized to fit over a power cord and flexible strain relief device 24 as shown in FIG. 1. As shown in FIG. 2, in one embodiment in which a strain relief bracket 28 of the present invention is permanently mounted to the electrical appliance, the tubular section encases the power cord 18 and flexible strain relief device 24, so that the distal end 34 of the tubular section 30 bears against the end 26 of the flexible strain relief device 24, and the proximal end of the tubular section bears against one side of the end 20 of handle 14 adjacent to one cutout, while the jaw 36 bears against an opposing side of the handle 14. When it is desired to change the position of the strain relief bracket 28, the operator need only grasp the tubular section 30, lift the jaw 36 out of the cutouts, pull the distal end 34 against the end 26 of the coiled spring strain relief device 24 to stretch the coiled spring, and reposition the jaw in whatever cutout 22, 22' or 22" is desired. When released after positioning the jaw 36, the strain relief bracket 28 is held in position in the cutouts 22, 22', 22" by the pressure exerted by the bent flexible strain relief device 24 against the interior surface of the tubular section 30, and by the end 26 of the coiled spring 24 compressing against the distal end 34 of the tubular section 30, forcing the proximal end 32 of tubular section 30 against the side of the handle 14. The length of the tubular section 30 is preferably selected to allow for compression by the strain relief 24, and to extend the power cord 18 sufficiently away from the electrical appliance so that the power cord will not become an obstacle to the appliance.

In a less preferred, alternative embodiment of a permanently installed strain relief bracket, the spacer arm 38 can be mounted for rotation on the end 20 of handle 14 in any conventional way, including, for example, using a ball joint and socket arrangement with a socket provided on the end 20 of handle 14, and the ball joint extending from the end of the spacer arm 38. In such an arrangement, it would be possible to eliminate entirely the flexible strain relief device, and feed the power cord 14 through the point of rotation and from thence through the hollow tubular section 30. A conventional detent locking device could be used to secure the power cord in a desired position to either side of the appliance or to the rear.

Figure 7:
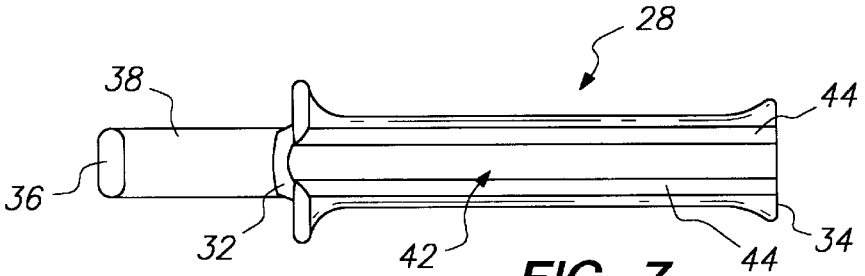

In an alternative embodiment, shown in FIGS. 4, 5, and 7 a removable strain relief bracket 28 is provided. In this embodiment, a longitudinal slot 42 having sufficient width to enable a flexible strain relief device such as coiled spring 24 and/or power cord 18 to be pushed through, is cut through the wall of the tubular section 30 and extends from the proximal end 32 to the distal end 34. Most preferably, the wall 44 is cut at an angle as shown in FIG. 5, so that a line drawn from the longitudinal center of the tubular section 30 and extending so as to coincide with the walls 44 of the slot 42 will form an angle of from about 69 degrees to about 73 degrees. With a slot cut in this fashion, and with the removable strain relief bracket of this embodiment formed from a semi-rigid material such as nylon, polyethylene, polypropylene or the like, the slot opening into the tubular section 30 can be slightly smaller than the outer circumference of the flexible strain relief device and/or power cord. To attach a removable bracket of this embodiment, the end 26 of the flexible strain relief device 24 is pulled away from the handle 14, and the removable bracket is positioned over the flexible relief device with the slot 42 on the flexible strain relief device, and with the distal end 34 positioned towards or against end 26, and proximal end 32 adjacent to the handle 14. The flexible relief device 24 is pressed through the slot 42, momentarily forcing the walls 44 apart to enable the flexible relief device to pass into the interior of tubular section 30. Once the flexible strain relief device is inside the tubular section 30, the walls 44 return to their normal position, thus holding the tubular section 30 in position on the flexible strain relief device 24 and/or power cord. The jaw 36 is positioned as desired over the cutouts 22, 22', 22", and the end 26 of flexible strain relief device 24 is released to secure the bracket 28 in position relative to the end 20 of handle 14.

Figure 6:
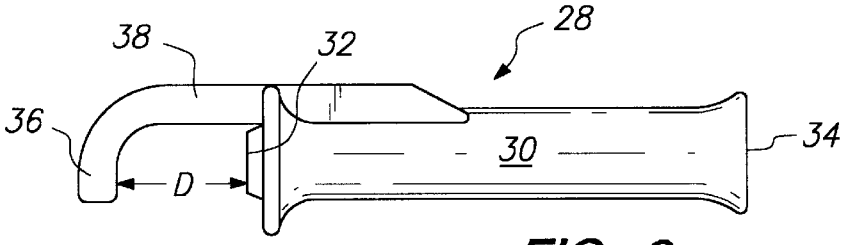
FIG. 6 is a second side view of the strain relief bracket shown in FIG. 3; and, FIG. 7 is a bottom view of a removable strain relief bracket as shown in FIG. 5.

The distance D, as shown in FIG. 6, between the proximal end 32 of the tubular section 30 and the interior surface of jaw 36 is determined by the width of the appliance handle 14 at the end 20 of the handle where the power cord 18 emerges from the handle 14.

A rigid strain relief bracket 28 of the present invention is particularly useful with carpet seaming irons. By securing the power cord off to one side and outside of the area of the seam to be formed, the ease of placing the seaming iron between the abutting carpet edges to be joined is tremendously enhanced. It also becomes much easier to remove the iron from the hot melt carpet seaming tape without worry that the cord will present an obstruction. In addition, it is much easier for an operator to place the seaming iron in a holding tray. Finally, and most importantly, since the power cord is kept away from the active seaming area, and thus does not present an obstacle to the iron or the operator during use, the operator can concentrate on creating a good seam during the very short working time available after the hot melt adhesive on the seaming tape has been melted by the carpet seaming iron. As described in more detail above, the rigid strain relief bracket can be provided as an integral part of a carpet seaming iron, or can be provided as a "clip-on" device which can be attached to virtually any conventional carpet seaming iron without using tools or special hardware.

One skilled in the art will recognize at once that it would be possible to construct the present invention from a variety of materials and in a variety of different ways. While the preferred embodiments have been described in detail, and shown in the accompanying drawings, it will be evident that various further modification are possible without departing from the scope of the invention as set forth in the appended claims.

What is claimed is:

1. A substantially rigid strain relief bracket for use with an electrical appliance, said strain relief bracket comprising:

a substantially rigid, hollow tubular section having a proximal end adjacent to a handle, a distal end, and a wall, the proximal end and the distal end being spaced apart a distance sufficient to move a power cord away from one side of the appliance, said tubular section having an interior circumference for enclosing a portion of the power cord adjacent to the handle of the appliance; and, a substantially rigid spacer arm extending from said proximal end of said tubular section, and a means disposed at an end of said spacer arm for mounting said spacer arm to said handle.

2. The strain relief bracket of claim 1 wherein said appliance is a carpet seaming iron.

3. The strain relief bracket of claim 2 wherein the handle of the carpet seaming iron includes cutouts adjacent to a point where the power cord exits the handle, and wherein said means disposed at the end of said spacer arm for mounting said spacer arm to the handle is a jaw having an interior surface which is substantially perpendicular to a longitudinal axis passing through a longitudinal center of said tubular section, said jaw being spaced from said proximal end of said tubular section by a distance which is sufficient to enable the cutouts at the end of the handle to be captured between said proximal end of the tubular section and said jaw.

4. The strain relief bracket of claim 1 additionally including means for removably securing the bracket to the power cord.

5. The strain relief bracket of claim 4 wherein said means for removably securing the bracket to the power cord is a longitudinal slot cut through the wall of said tubular section, said slot positioned parallel to said longitudinal axis and extending from said proximal end to said distal end of said tubular section to allow the power cord to be inserted into and removed from said tubular section.

6. The strain relief bracket of claim 5 wherein said slot is formed by cutting at an angle through said wall of said tubular portion at two places from said proximal end to said distal end to form a first and second slot wall whereby a first line drawn from a longitudinal center of said tubular portion and extending outward to coincide with the first slot wall and a second line drawn from said longitudinal center outward to coincide with the second slot wall will form between them an angle of from about 69 degrees to about 73 degrees.

7. The strain relief bracket of claim 1 wherein said tubular portion and said spacer arm are constructed from a substantially rigid plastic material.

8. The strain relief bracket of claim 7 wherein said tubular portion and said spacer arm are formed as a single piece.

9. The strain relief bracket of claim 1 additionally including a means for preventing unrestricted movement of said bracket.

10. The strain relief bracket of claim 9 wherein said means for preventing unrestricted movement of said bracket comprises at least one cutout on the handle of the electrical appliance.

11. An improved electrical appliance having a handle, and an end on said handle from which an electric power cord emerges, the improvement comprising:

a substantially rigid strain relief bracket attached to the power cord at the end of the handle, said strain relief bracket of sufficient length to extend the power cord away from a side of the appliance, said strain relief bracket including a hollow, tubular section enclosing the power cord, the tubular section having a proximal end adjacent to the handle, and a spacer arm extending from said proximal end of said tubular section and terminating in a means for movably attaching said rigid strain relief bracket to the end of the handle.

12. The improved appliance of claim 11 additionally including a means for preventing unrestricted movement of said bracket.

13. The improved appliance of claim 12 wherein said means for preventing unrestricted movement of said bracket comprises at least one cutout on said handle.

14. The improved appliance of claim 11 wherein said means for movably attaching said rigid strain relief bracket to said handle end is a jaw member disposed on an end of said spacer arm to be perpendicular to a longitudinal axis passing through a longitudinal center of said tubular section, said jaw being spaced apart from said proximal end of said tubular section by a distance which is sufficient to secure the strain relief bracket in one or more cutouts provided at the end of the handle.

15. The improved appliance of claim 11 wherein the appliance is a carpet seaming iron.

16. The improved appliance of claim 15 wherein a combined length of said tubular section and said spacer arm are sufficient to substantially remove the power cord from a seaming area when the carpet seaming iron is in use.

17. The improved appliance of claim 11 wherein said strain relief bracket is removable.

18. The improved appliance of claim 17 wherein said strain relief bracket includes a longitudinal groove cut through a wall of said tubular section and passing from a distal end of said tubular section to said proximal end.

* * * * *